US011070002B2

(12) United States Patent
Chen et al.

(10) Patent No.: US 11,070,002 B2
(45) Date of Patent: Jul. 20, 2021

(54) CONNECTOR WITH GUIDING PORTION, AND SHELL AND INSULATING BODY OF THE SAME

(71) Applicant: Amphenol East Asia Limited Taiwan Branch (H.K.), Taoyuan (TW)

(72) Inventors: Chien-Ming Chen, Taoyuan (TW); Szu-Ting Liao, Taoyuan (TW)

(73) Assignee: AMPHENOL EAST ASIA LIMITED TAIWAN BRANCH (H.K.), Taoyuan (TW)

( * ) Notice: Subject to any disclaimer, the term of this patent is extended or adjusted under 35 U.S.C. 154(b) by 0 days.

(21) Appl. No.: 16/572,767

(22) Filed: Sep. 17, 2019

(65) Prior Publication Data

US 2020/0220294 A1 Jul. 9, 2020

(30) Foreign Application Priority Data

Jan. 9, 2019 (TW) ..... 108200384
Feb. 21, 2019 (TW) ..... 108202188

(51) Int. Cl.
*H01R 13/516* (2006.01)
*H01R 13/627* (2006.01)
*H01R 13/631* (2006.01)

(52) U.S. Cl.
CPC ..... *H01R 13/516* (2013.01); *H01R 13/627* (2013.01); *H01R 13/631* (2013.01)

(58) Field of Classification Search
CPC .... H01R 13/631; H01R 24/38; H01R 12/721; H01R 12/73; H01R 12/79; H01R 12/91; H01R 13/648; H01R 13/6582; H01R 13/6587; H01R 13/6593; H01R 12/51; H01R 12/52; H01R 12/57; H01R 12/707; H01R 12/716; H01R 12/727; H01R 12/737; H01R 13/00; H01R 13/005; H01R 13/04; H01R 13/115; H01R 13/193; H01R 13/20; H01R 13/26; H01R 13/405; H01R 13/41; H01R 13/4364; H01R 13/46; H01R 13/50;
(Continued)

(56) References Cited

U.S. PATENT DOCUMENTS 6,050,852 A * 4/2000 Wu ..... H01R 13/629 439/607.02
6,179,662 B1 * 1/2001 Kuo ..... H01R 13/6582 439/607.53
(Continued)

FOREIGN PATENT DOCUMENTS

CN 208461071 U 2/2019
TW 286861 B 9/2007

*Primary Examiner* — Truc T Nguyen
(74) *Attorney, Agent, or Firm* — CIPO IP Group

(57) ABSTRACT

A connector with at least one guiding portion is provided along with a shell and an insulating body of the connector. The connector includes a plurality of metal terminals in addition to the insulating body and the shell. The metal terminals are fixedly provided in the insulating body. The insulating body is mounted in the shell, and the connector is characterized in that at least one plate-shaped guiding portion extends upward from a portion of the top edge of either the shell or the insulating body. While another connector is being connected to or disconnected from the connector, the guiding portion guides the another connector to facilitate electrical connection with or detachment from the connector.

14 Claims, 10 Drawing Sheets

(58) Field of Classification Search
CPC .. H01R 13/502; H01R 13/506; H01R 13/514; H01R 13/518; H01R 13/52; H01R 13/5808; H01R 13/625; H01R 13/6315; H01R 13/633; H01R 13/639; H01R 13/6471; H01R 13/658; H01R 13/6581; H01R 13/6585; H01R 13/659; H01R 13/6592; H01R 13/6594; H01R 13/6683; H01R 13/74; H01R 13/741; H01R 2201/04; H01R 24/64; H01R 25/006; H01R 33/205; H01R 43/0235; H01R 43/0256; H01R 43/0263; H01R 43/205; H01R 43/26; H01R 4/02; H01R 9/0518
See application file for complete search history.

(56) References Cited

U.S. PATENT DOCUMENTS 6,241,556 B1 * 6/2001 Chih ..... H01R 12/7047 439/607.01
6,267,624 B1 * 7/2001 Wu ..... H01R 13/658 439/607.35
6,319,060 B1 * 11/2001 Wu ..... H01R 13/658 439/607.13
6,508,660 B2 * 1/2003 Self ..... H01R 13/6271 439/374
6,755,690 B1 * 6/2004 Zhang ..... H01R 13/658 439/607.02
6,824,969 B1 * 11/2004 Ko ..... H01R 12/725 439/680
8,348,701 B1 * 1/2013 Lan ..... H01R 12/716 439/607.19
2003/0232545 A1 * 12/2003 Kappel ..... H01R 43/26 439/709
2006/0141866 A1 * 6/2006 Shiu ..... H01R 13/506 439/607.35
2006/0160399 A1 * 7/2006 Dawiedczyk ..... H01R 12/716 439/374
2006/0246762 A1 * 11/2006 Chen ..... H04N 5/2257 439/331
2006/0258218 A1 * 11/2006 Chen ..... H01R 9/226 439/607.35
2006/0292930 A1 * 12/2006 Shimoyama ..... H01R 13/6594 439/607.35
2007/0141901 A1 * 6/2007 Koyama ..... H01R 13/6582 439/552
2007/0149055 A1 * 6/2007 Watanabe ..... H01R 13/6594 439/607.01
2008/0096429 A1 * 4/2008 Mikolajczak ..... H01R 13/68 439/620.08
2010/0068932 A1 * 3/2010 Tsai ..... H01R 13/65802 439/607.01
2010/0093213 A1 * 4/2010 Li ..... H01R 12/00 439/607.01
2012/0028497 A1 * 2/2012 Su ..... H01R 13/648 439/488
2013/0089997 A1 * 4/2013 Orris ..... H01R 12/592 439/329
2013/0231004 A1 * 9/2013 Yang ..... H01R 13/658 439/607.36
2014/0206231 A1 * 7/2014 Guo ..... H01R 13/6594 439/607.01
2018/0205177 A1 * 7/2018 Zhou ..... H01R 13/631
2018/0301829 A1 * 10/2018 Hoyack ..... H01R 13/6582
2019/0058288 A1 * 2/2019 Sakaizawa ..... H01R 13/6582
2019/0067854 A1 * 2/2019 Ju ..... H01R 12/727

* cited by examiner

CONNECTOR WITH GUIDING PORTION, AND SHELL AND INSULATING BODY OF THE SAME

FIELD OF THE INVENTION

The present invention relates to a connector and more particularly to a connector whose shell or insulating body has a guiding portion so that the connector can be easily connected to another connector under the guidance of the guiding portion.

BACKGROUND OF THE INVENTION

Due to the advancement of electronic and communication technologies, electronic devices are nowadays equipped with a variety of functions and have become indispensable tools in our daily lives. Some notable examples of such devices are mobile phones, which allow people in different parts of the world to communicate with one another; powerbanks, which can be carried around to supply electricity to mobile phones continuously; portable audio players, which satisfy our need to listen to music anywhere anytime; and personal computers, which are depended upon to help with all sorts of things.

In order to receive electronic signals and electric power from the outside, an electronic device (e.g., be it a smartphone, tablet computer, desktop computer, laptop computer, or digital camera) must be provided with a connector on the device body. As used herein, the term "connector" refers to a connecting device for use with electronic signals and/or electric power and to its accessories. Connectors can be viewed as bridges for all kinds of signals, and their quality affects the reliability of signal and/or current transmission and is therefore crucial to the operation of electronic devices. Connectors also allow a plurality of electronic devices to be connected as a complete system and to transmit electronic signals and/or electric power to one another. In fact, therefore, connectors are essential to electronic devices in that the latter cannot carry out their predetermined functions without the former.

Connector structures vary with their applications and installation locations in order to adapt to and meet user needs. For example, as the concept and use of intelligent vehicles become increasingly prevalent, the demand for automotive connectors is rising substantially. One of the challenges facing automotive connectors is that two connected automotive connectors in a vehicle may eventually come loose, if not separate, from each other as a result of the vibrations generated by the vehicle running on bumpy roads. Moreover, automotive connectors are generally compact in size to save space, but the fact that most of the space in a vehicle (particularly the passenger compartment) must be left vacant for the driver's or passengers' comfort requires that automotive connectors be disposed adjacent to other components of the vehicle, which makes it difficult to plug in and unplug those connectors. In particular, if the location where two automotive connectors are to be connected is blocked from view, accurate connection of the connectors can be a problem, or a mechanic may pull one of the connectors away from the other in a wrong direction (e.g., slantingly) such that the internal components (e.g., the tongue plates or terminals) of the connectors are broken or otherwise damaged and lead to poor connector operation.

The issue to be addressed by the present invention is to avoid the aforesaid undesirable scenarios by providing a connector that can be connected to and disconnected from another connector with greater ease than in the prior art.

BRIEF SUMMARY OF THE INVENTION

As the general structure of the conventional connectors still leaves something to be desired in terms of use, the inventor of the present invention incorporated years of practical experience in the design, processing, and manufacture of various signal and power connectors and the spirit of continued perfection into an extensive research and experiment and finally succeeded in developing a connector with at least one guiding portion and the metal shell and insulating body of the connector. The invention is intended to increase the ease of connection and disconnection of connectors and thereby provide better user experience.

One objective of the present invention is to provide a metal shell that has a guiding portion and is applied to a connector. The metal shell is formed by bending at least one metal plate and has a cross section that is at least U-shaped in order to form a vertically throughgoing assembly space into which an insulating body can extend and in which the insulating body can be fixed. The metal shell is characterized in that at least one plate-shaped guiding portion extends upward from a portion of its top edge. When it is desired to connect another connector to the connector, the another connector can be pressed against the guiding portion in order for the guiding portion to guide the another connector into electrical connection with the connector.

Another objective of the present invention is to provide a connector having a guiding portion. The connector is composed of an insulating body, a plurality of metal terminals, and a metal shell. The metal terminals are fixedly provided in the insulating body. The insulating body is mounted in the metal shell together with the metal terminals. The connector is characterized in that the metal shell is formed by bending at least one metal plate and has a cross section that is at least U-shaped in order to form a vertically throughgoing assembly space into which the insulating body can extend and in which the insulating body can be fixed. The metal shell is characterized in that at least one plate-shaped guiding portion extends upward from a portion of its top edge. When it is desired to connect another connector to the connector or disconnect another connector from the connector, the guiding function of the guiding portion ensures accurate connection or disconnection so that both connectors are protected from damage attributable to an improper connecting or disconnecting operation.

Yet another objective of the present invention is to provide an insulating body having a guiding portion. The insulating body is embedded with a plurality of metal terminals and extends into a shell to form a connector. The insulating body is characterized in that at least one plate-shaped guiding portion extends upward from a portion of its top edge. When it is desired to connect another connector to the connector, the another connector can be pressed against the guiding portion in order for the guiding portion to guide the another connector into electrical connection with the connector.

BRIEF DESCRIPTION OF THE SEVERAL VIEWS OF THE DRAWINGS

The objectives, technical features, and effects of the present invention can be better understood by referring to the following detailed description of some illustrative embodiments in conjunction with the accompanying drawings, in which.

DETAILED DESCRIPTION OF THE INVENTION

Figure 1:
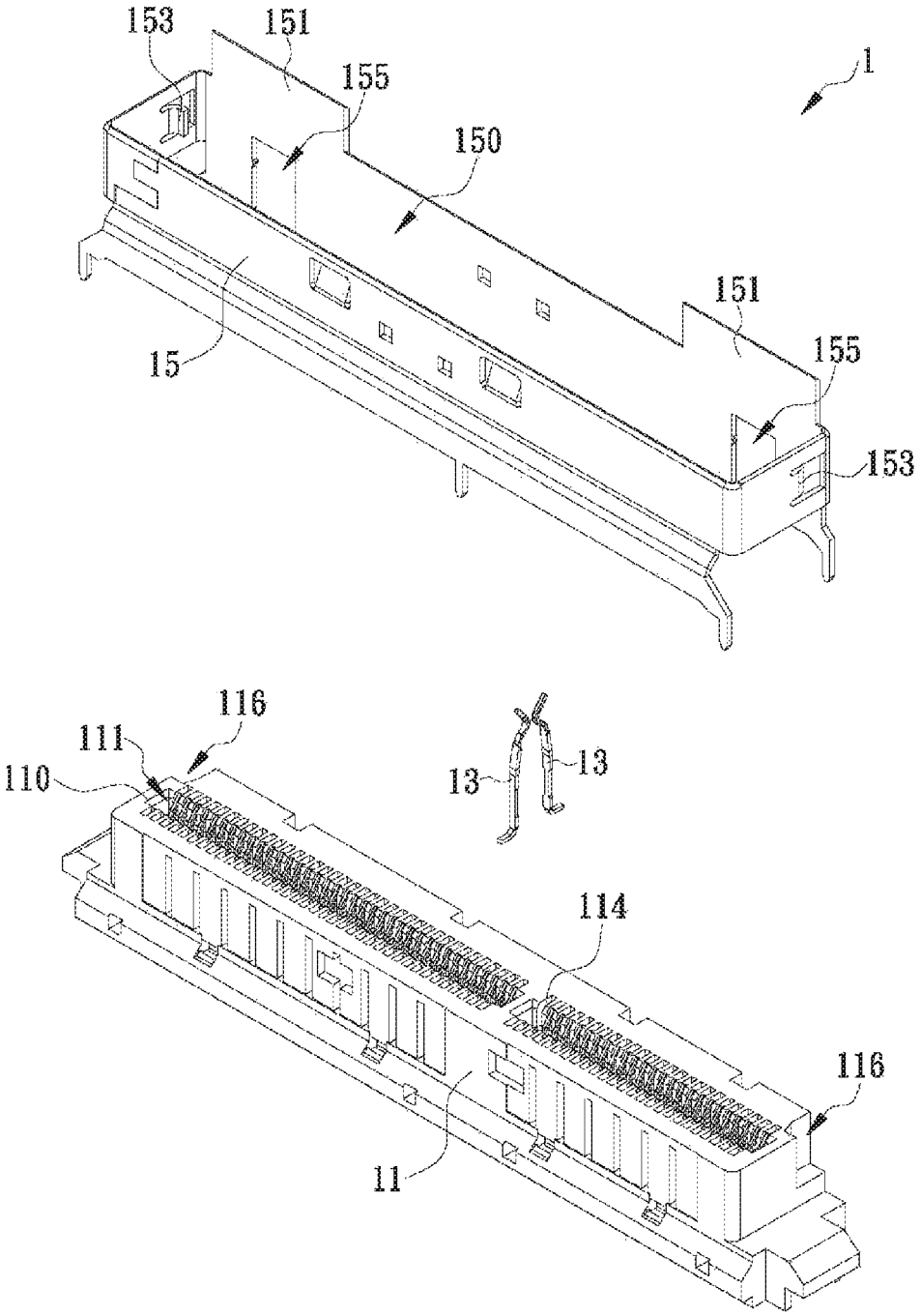
FIG. 1 is an exploded perspective view of a connector according to the present invention.
Figure 2:
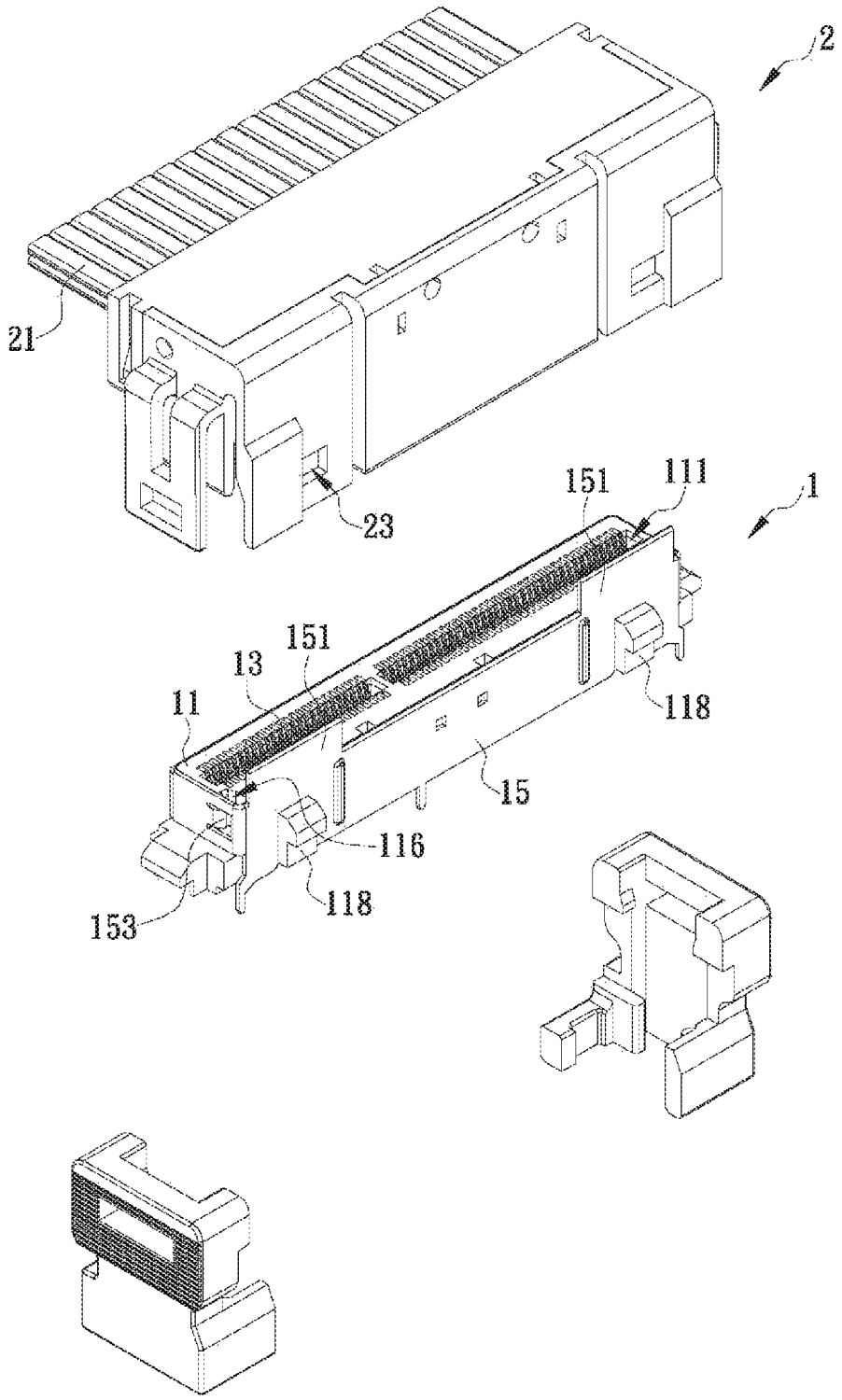
FIG. 2 is a top perspective view of the connector in FIG. 1 and another connector.

The present invention discloses a connector with at least one guiding portion and also discloses the shell and insulating body of the connector. In one embodiment of the invention as shown in FIG. 1 and FIG. 2, the connector 1 includes an insulating body 11, a plurality of metal terminals 13, and a shell 15. To facilitate description, the top side of each component of the connector 1 is defined as facing the top edge of FIG. 1, the bottom side of each component is defined as facing the bottom edge of FIG. 1, the left side of each component is defined as facing the upper left corner of FIG. 1, the right side of each component is defined as facing the lower right corner of FIG. 1, the front side of each component is defined as facing the lower left corner of FIG. 1, and the rear side of each component is defined as facing the upper right corner of FIG. 1. It should be pointed out that the configurations of the connector 1, the insulating body 11, and the shell 15 are not limited to those depicted in FIG. 1. A manufacturer may adjust the configuration of each component according to product requirements, provided that the connector 1, the insulating body 11, and the shell 15 have the structures and functions disclosed in the following embodiments.

In the embodiment shown in FIG. 1 and FIG. 2, the top side of the insulating body 11 is formed with an insertion hole 110. The insertion hole 110 is provided therein with a receiving space 111 in communication with the insertion hole 110. Two opposite inner sides of the insulating body 11 are each formed with a plurality of terminal grooves 114. The insertion hole 110, the terminal grooves 114, and the receiving space 111 communicate with one another. In other embodiments of the present invention, the insulating body 11 may dispense with the terminal grooves 114 or be additionally provided therein with a tongue plate in which the terminal grooves 114 are formed, in order to adapt the structure disclosed herein to various types of connectors 1.

Figure 3:
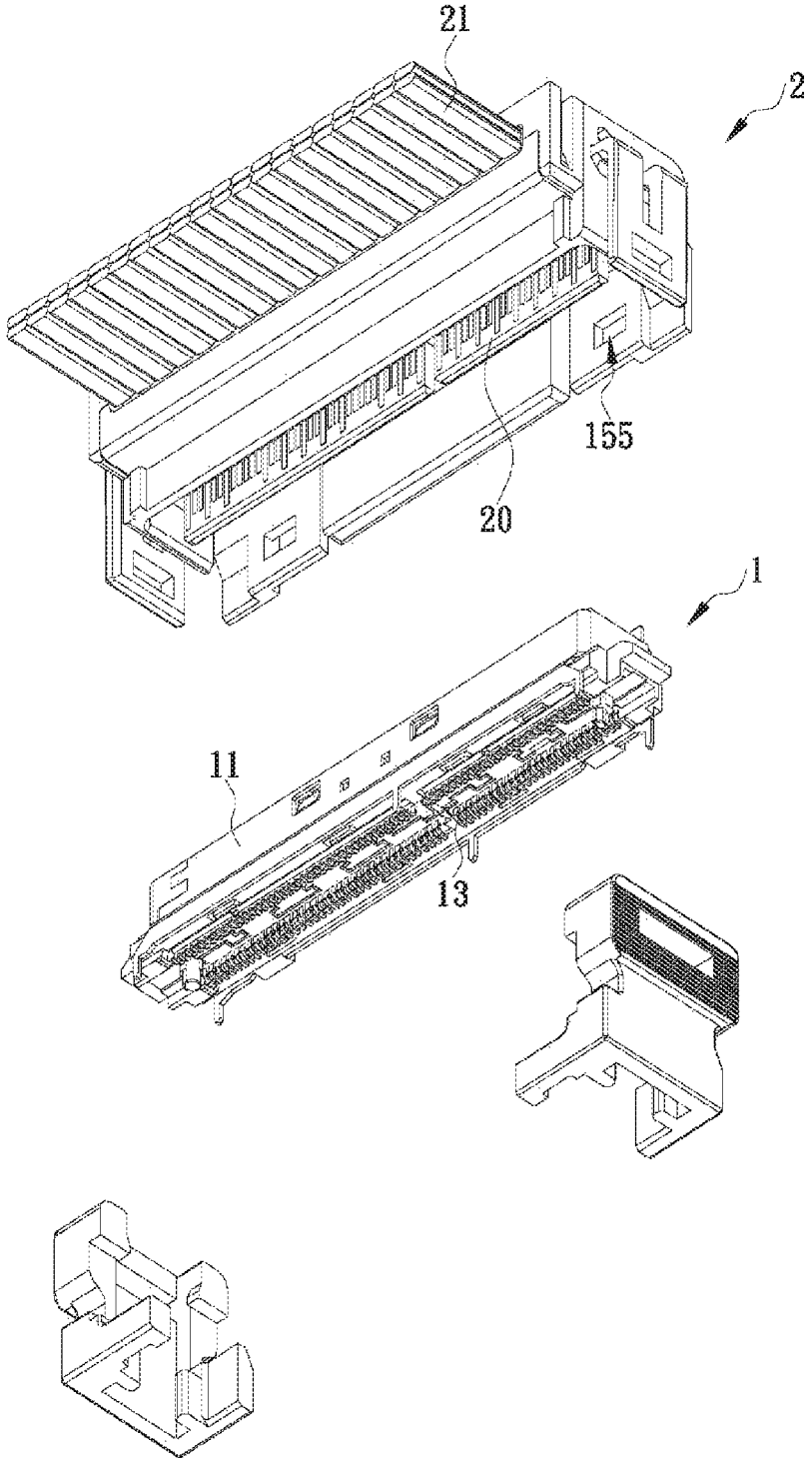
FIG. 3 is a bottom perspective view of the connectors in FIG. 2.

As shown in FIG. 1 and FIG. 2, the metal terminals 13 are fixedly provided in the insulating body 11 and are spaced apart from one another. The metal terminals 13 in this embodiment may be at least one or a combination of signal terminals, ground terminals, and power terminals, and are fitted in the terminal grooves 114 respectively such that the top end of each metal terminal 13 is exposed through the receiving space 111 (see FIG. 1). When another connector 2 is connected with the connector 1, each terminal 21 of the connector 2 (e.g., each gold finger on the tongue plate 20 in FIG. 3) has one end extending into the receiving space 111 through the insertion hole 110 and electrically connected to the aforesaid end of the corresponding metal terminal 13 to enable an exchange of signals or electric current between the two connectors 1 and 2. The opposite end of each metal terminal 13 extends out of the bottom end of the insulating body 11 (see FIG. 3) in order to be connected (e.g., soldered) to a circuit board or other component.

With continued reference to FIG. 1 and FIG. 2, the shell 15 is formed by bending at least one metal plate. In this embodiment, the shell 15 has a rectangular cross section such that a vertically throughgoing assembly space 150 is formed in and surrounded by the shell 15. The shell 15, however, is not necessarily shaped as shown in FIG. 1, provided that the shell 15 has a rectangular-shaped cross section capable of forming the vertically throughgoing assembly space 150. The insulating body 11 is configured to extend into the assembly space 150 and be fixed in the shell 15 (as shown in FIG. 2) in order for the shell 15 to shield the metal terminals 13 from electromagnetic interference (EMI), to serve as a grounding path for the metal terminals 13, and to protect the insulating body 11.

As shown in FIG. 1 and FIG. 2, at least one guiding portion 151 extends upward from a portion of the top edge of the shell 15, and in this embodiment, two guiding portions 151 are provided on the rear side of the top edge of the shell 15. In other embodiments of the present invention, the at least one guiding portion 151 may be provided on the left, right, or front side of the top edge of the shell 15 instead, and if there are a plurality of guiding portions 151, they may be provided on different sides of the top edge of the shell 15 to meet product requirements. Each guiding portion 151 is plate-shaped. To connect the connector 2 to the connector 1, referring to FIG. 4A and FIG. 4B, the connecting process may begin by pressing the connector 2 against the guiding portions 151, e.g., with the rear inner side of the connector 2 in contact with the guiding portions 151. Then, under the guidance of the guiding portions 151, the connector 2 is slid downward toward the connector 1 until the tongue plate 20 of the connector 2 is inserted into the receiving space 111 of the connector 1 (see FIG. 5) to complete electrical connection between the connectors 1 and 2.

Figure 6:
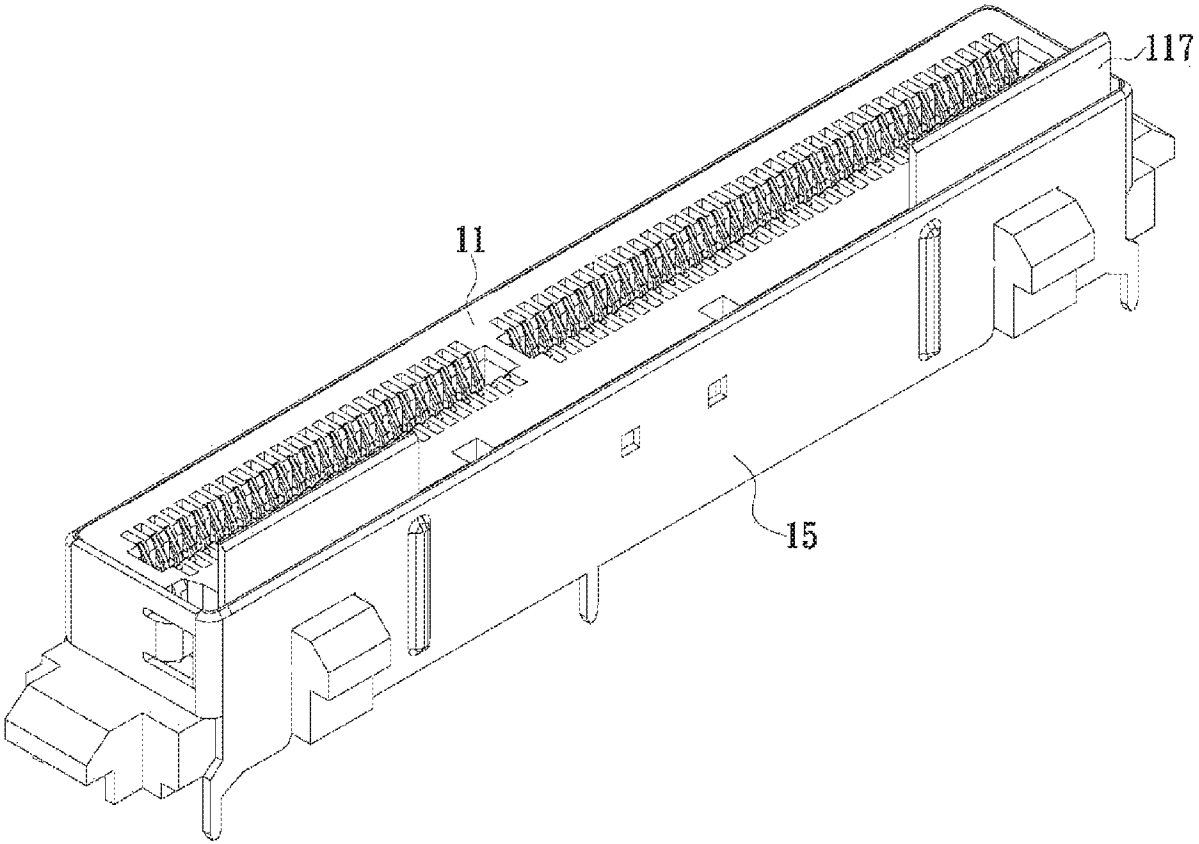
FIG. 6 is a perspective view of another connector according to the invention, wherein the insulating body, rather than the shell, has two guiding portions.
Figure 7:
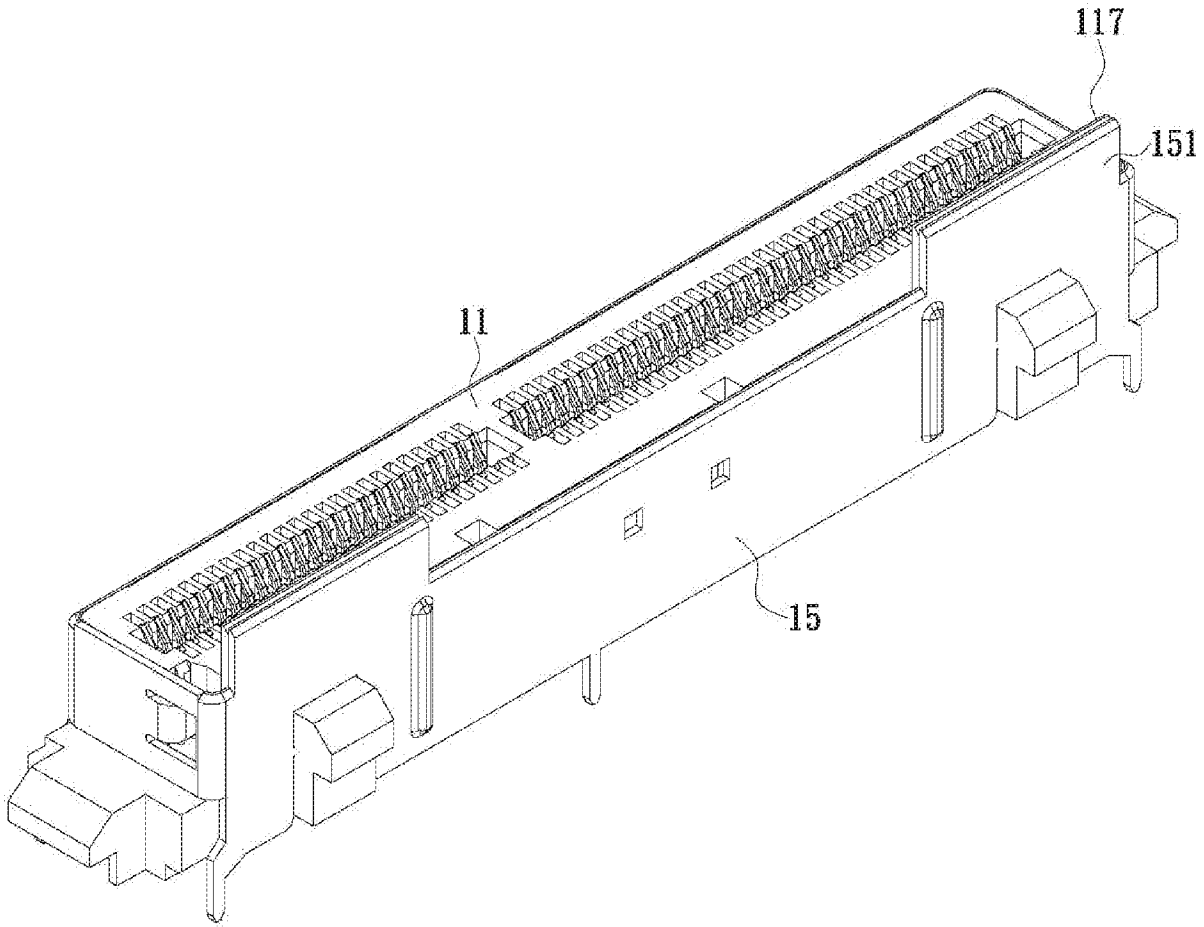
FIG. 7 is a perspective view of yet another connector according to the invention, wherein the insulating body as well as the shell has two guiding portions.

While the guiding portions 151 in this embodiment are provided on the shell 15, another embodiment of the present invention may be so configured that at least one guiding portion 117 extends upward from a portion of the top edge of the insulating body 11 instead, as shown in FIG. 6, or that the guiding portions 117 and 151 are provided respectively on the insulating body 11 and the shell 15 and lie flat against each other, as shown in FIG. 7, the objective being to increase the overall strength of the guiding portions 117 and 151 so that the guiding portions will not easily break or bend upon collision. The guiding portions 117 and 151 are designed to produce the following effects:

(1) Thanks to their relatively great height, the guiding portions 117 and/or 151 will be the first portions of the connector 1 that come into contact with the connector 2, and this allows the connectors 1 and 2 to be connected accurately and easily. When it is desired to disconnect the connector 2 from the connector 1, the guiding portions 117 and/or 151 also serve as a guide so that the connector 2 can be pulled away from the connector 1 in the correct direction, or at least without deviating too much from the correct direction, thereby protecting the internal components (e.g., the tongue plate 20) of the connector 2 from damage (e.g., breakage) by an improper disconnecting operation.

(2) Once the connectors 1 and 2 are connected, the guiding portions 117 and/or 151 are received in an existing space in the connector 2 (see FIG. 5), so the connector 2 need not be increased in volume. This is in line with the design trend of making connectors as compact as possible.

Figure 5:
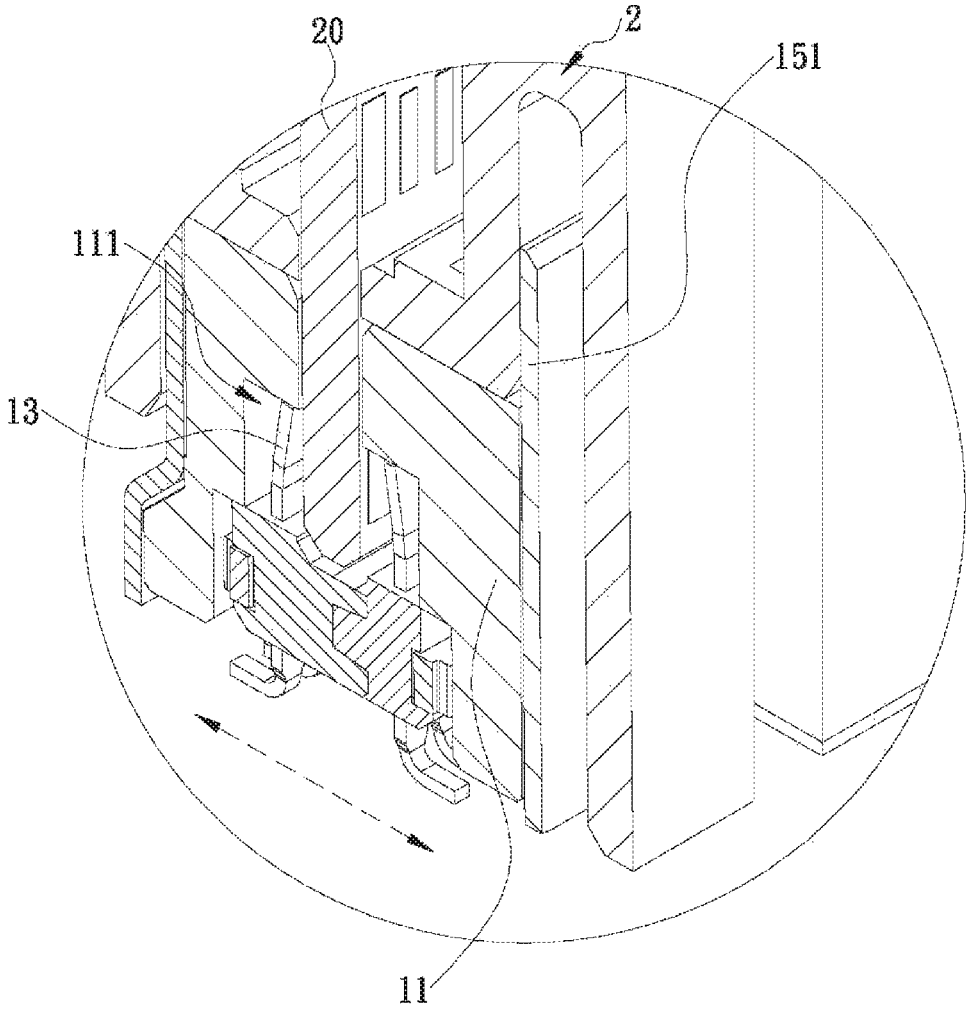
FIG. 5 is a partial sectional view of the connected connectors in FIG. 4A and FIG. 4B.

(3) When the connectors 1 and 2 are used as automotive connectors, referring to FIG. 5 to FIG. 7, the guiding portions 117 and/or 151 help increase the area of contact between the connectors 1 and 2 so that not only are the connectors 1 and 2 kept from separating from each other under vibration (caused by a bumpy road for example), but also the internal components of the connectors (e.g., the tongue plate 20) are protected from damage that may otherwise result from an exceedingly large lateral pressure (indicated by the dashed-line arrows in FIG. 5).

To ensure that the shell 15 and the insulating body 11 are securely put together, the embodiment shown in FIG. 1 and FIG. 2 is so configured that the insulating body 11 is provided with a groove 116 in each of its left and right sidewalls, that each groove 116 extends downward from the top edge of the insulating body 11, that the shell 15 is provided with an engaging plate 153 on each of its left and right sidewalls, and that each engaging plate 153 protrudes toward the assembly space 150. When the insulating body 11 is inserted upward into the assembly space 150, each engaging plate 153 extends into, and presses against the wall of, the corresponding groove 116. Once the connectors 1 and 2 are connected (see FIG. 4A and FIG. 4B), therefore, pulling the connector 2 away from the connector 1 will not separate the insulating body 11 from the shell 15 because, although subjected to an upwardly displacing force generated by the connector 2, the insulating body 11 is blocked by the engaging plates 153 to preserve the structural integrity of the connector 1.

Moreover, the embodiment shown in FIG. 1 and FIG. 2 is so configured that the insulating body 11 is provided with at least one protruding block 118 on the rear side, that the shell 15 is formed with at least one engaging hole 155 in the rear side, and that the at least one engaging hole 155 extends upward from the bottom edge of the shell 15. When the insulating body 11 is inserted upward into the assembly space 150, each protruding block 118 extends into, and presses against the wall of, the corresponding engaging hole 155 (see FIG. 2). Once the connectors 1 and 2 are connected (see FIG. 4A and FIG. 4B), therefore, the protruding blocks 118 and the engaging holes 155 can also prevent the insulating body 11 from separating from the shell 15 when the connector 2 is pulled away from the connector 1. In addition, the protruding blocks 118 may be so configured that the top end of each protruding block 118 is engageable in a corresponding opening 23 of the connector 2 to better secure the connectors 1 and 2 in the connected state.

Figure 4A:
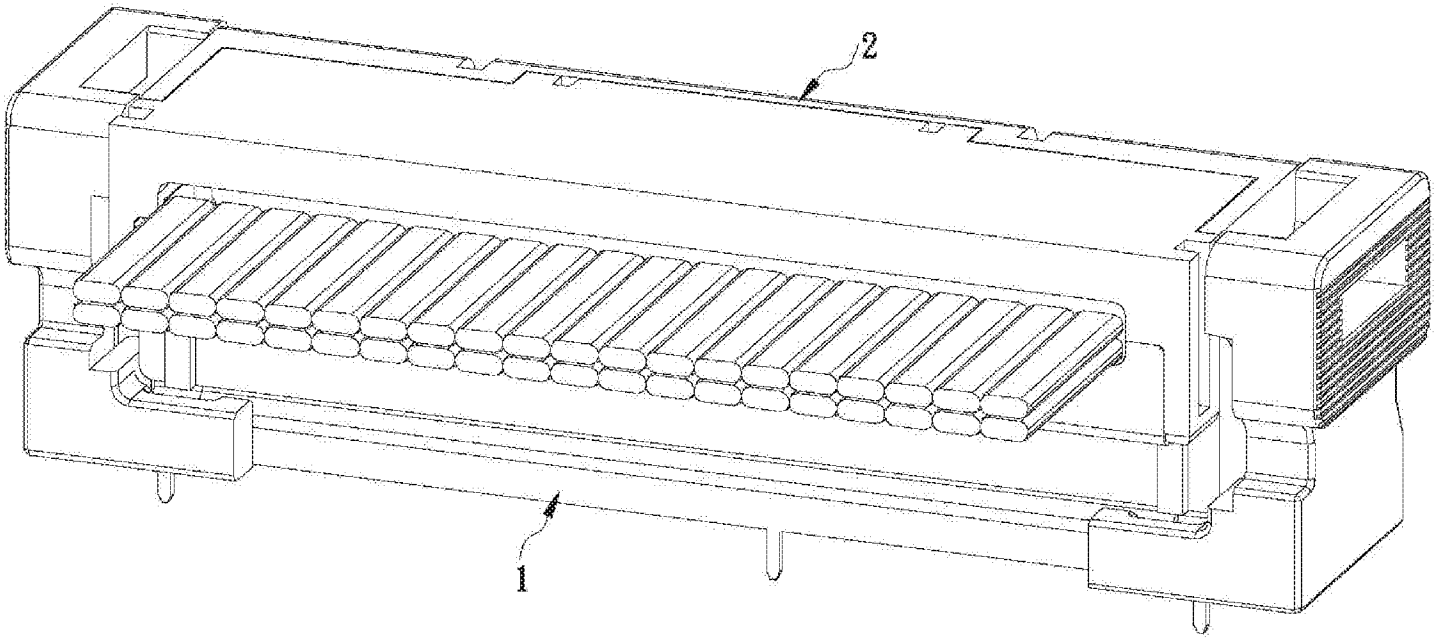
FIG. 4A shows the connectors in FIG. 2 and FIG. 3 in the connected state.
Figure 4B:
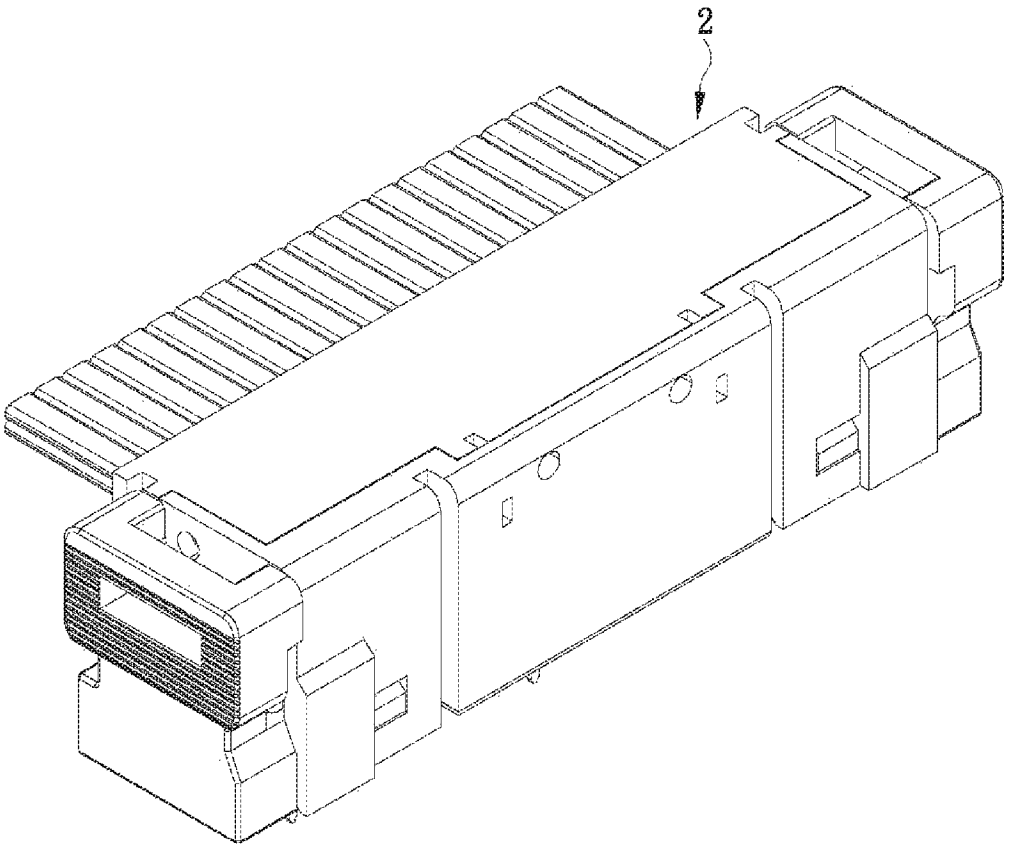
FIG. 4B shows the connected connectors in FIG. 4A from another viewing angle.
Figure 8:
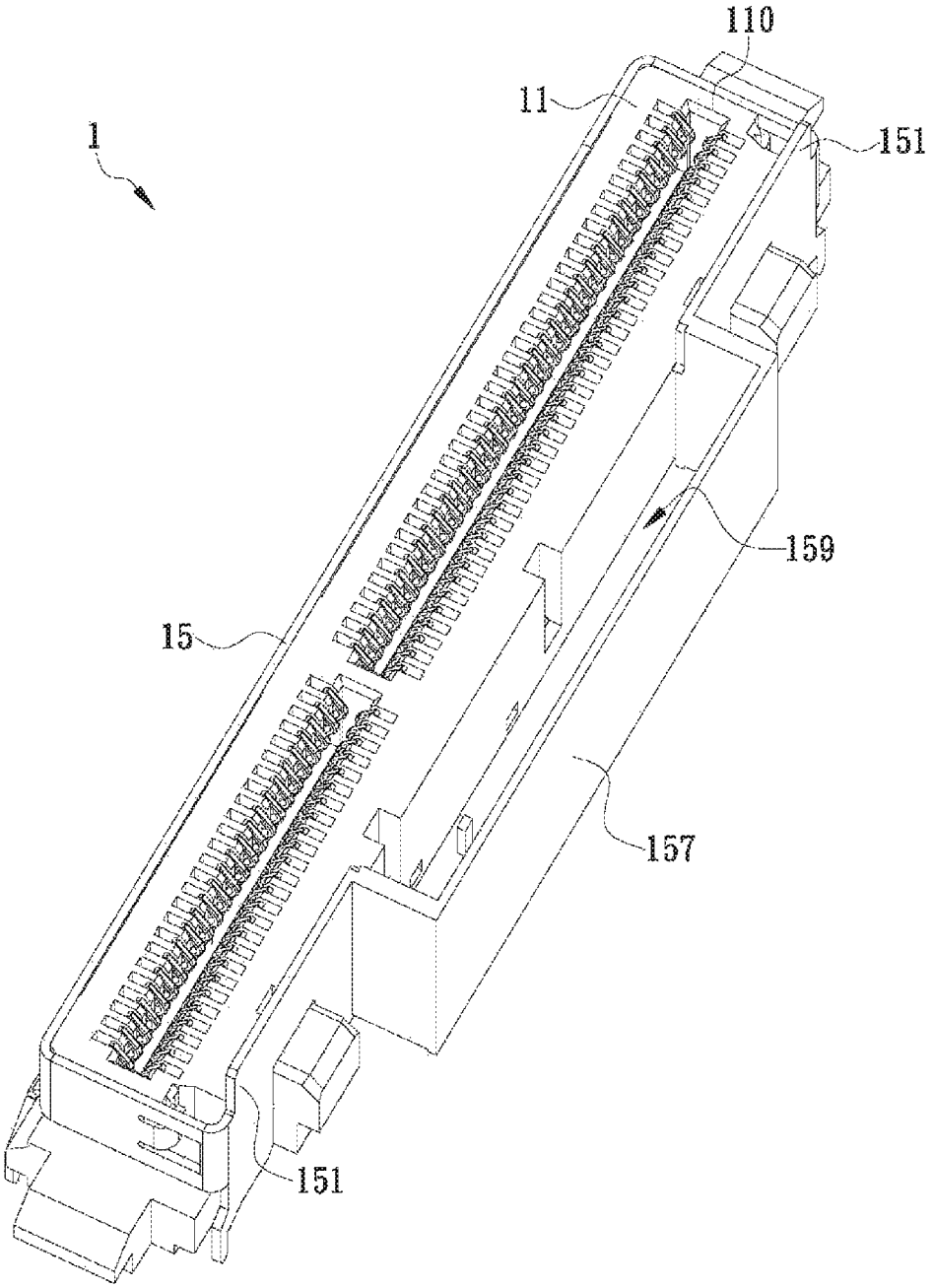
FIG. 8 is a perspective view of still another connector according to the invention, wherein the shell has a space forming portion.
Figure 9:
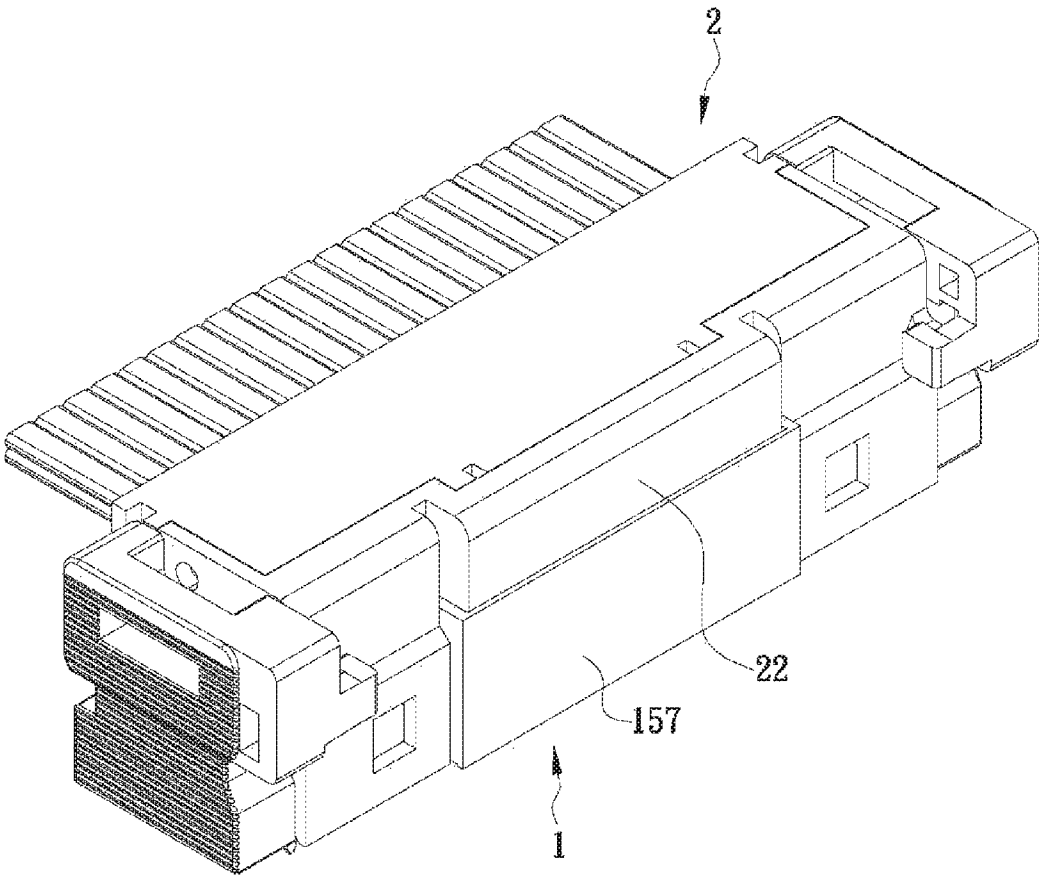
FIG. 9 shows the connector in FIG. 8 connected to another connector.

In the foregoing embodiment, the two guiding portions 151 are separate from each other and therefore prone to damage or breakage upon collision during the connecting process. Moreover, when the connectors 1 and 2 are connected as shown in FIG. 4A and FIG. 4B, most of the connector 1 is enclosed in the connector 2 such that the shell 15 of the connector 1 does not provide any protection to or produce any securing effect on the connector 2. Hence, in another embodiment of the present invention as shown in FIG. 8 (in which elements already existing in the previous embodiments retain their respective reference numerals), the two guiding portions 151 are located on the same side of the shell 15, and are respectively adjacent to two opposite ends of the insertion hole 110. An end edge of one of the guiding portions 151 corresponds and connects to an end edge of another one of the guiding portions 151 to form a space forming portion 157 between the guiding portions 151, wherein the inner side of the space forming portion 157 and the outer side of a sidewall of the insulating body 11 jointly form an insertion space 159. Referring to FIG. 9, while the connector 2 is being connected to the connector 1, the insertion space 159 guides, and is subsequently inserted by, a corresponding portion (e.g., a positioning portion 22) of the connector 2. Thus, not only is the overall strength of the two guiding portions 151 effectively increased by connecting the guiding portions 151 and the space forming portion 157 as a single unit, but also the space forming portion 157 will be outside the connector 2 (see FIG. 9) when the connectors 1 and 2 are connected, allowing the shell 15 of the connector 1 (or more specifically the space forming portion 157) to contribute to securing the connection between the connectors 1 and 2. It should be pointed out that the insulating body 11 in another embodiment may still have the corresponding guiding portions 117 as shown in FIG. 7, with each guiding portion 117 lying flat against the corresponding guiding portion 151 to increase the overall strength of the guiding portions 117 and 151.

While the invention herein disclosed has been described by means of specific embodiments, numerous modifications and variations could be made thereto by those skilled in the art without departing from the scope of the invention set forth in the claims.

What is claimed is:

1. A connector, comprising:

an insulating body having a top side formed with an insertion hole, the insulating body being provided therein with a receiving space in communication with the insertion hole;

a plurality of metal terminals embedded in the insulating body, wherein each said metal terminal has an end exposed through the receiving space and an opposite end extending out of the insulating body; and a shell having a rectangular-shaped cross section and thus forming a vertically throughgoing assembly space, the insulating body extending into and being fixed in the assembly space;

the connector being characterized in that:

the shell has two guiding portions on a same side and has a rear side formed with at least two engaging holes corresponding respectively in position to the two guiding portions and extending upward from a bottom edge of the shell, the guiding portions extend upward from a portion of a top edge of the shell, the guiding portions are plate-shaped, and to connect another connector to the connector, the another connector is able to be pressed against the guiding portions in order to be guided by the guiding portions into electrical connection with the connector;

wherein the insulating body has a rear side provided with at least one protruding block, and when the insulating body extends into the assembly space, the protruding block extends into, and presses against a wall of, a corresponding one of the engaging holes.

2. The connector of claim 1, wherein the insulating body has a left sidewall and a right sidewall each provided with a groove, each said groove extends downward from a top edge of the insulating body, the shell has a left sidewall and a right sidewall each provided with an engaging plate, each said engaging plate protrudes toward the assembly space, and when the insulating body extends into the assembly space, each said engaging plate extends into, and presses against a wall of, a corresponding said groove.

3. The connector of claim 1, wherein the insulating body is provided with at least one guiding portion.

4. The connector of claim 3, wherein at least one of the guiding portions of the shell and the at least one guiding portion of the insulating body lie flat against each other.

5. The connector of claim 1, wherein the two guiding portions are adjacent to two opposite ends of the insertion hole respectively, an end edge of one of the guiding portions corresponds and connects to an end edge of another one of the guiding portions to form a space forming portion between the guiding portions, an inner side of the space forming portion and an outer side of a sidewall of the insulating body jointly form an insertion space, and once the connector and the another connector are connected, the insertion space is inserted by a corresponding portion of the another connector.

6. The connector of claim 2, wherein the two guiding portions are adjacent to two opposite ends of the insertion hole respectively, an end edge of one of the guiding portions corresponds and connects to an end edge of another one of the guiding portions to form a space forming portion between the guiding portions, an inner side of the space forming portion and an outer side of a sidewall of the insulating body jointly form an insertion space, and once the connector and the another connector are connected, the insertion space is inserted by a corresponding portion of the another connector.

7. The connector of claim 1, wherein the two guiding portions are adjacent to two opposite ends of the insertion hole respectively, an end edge of one of the guiding portions corresponds and connects to an end edge of another one of the guiding portions to form a space forming portion between the guiding portions, an inner side of the space forming portion and an outer side of a sidewall of the insulating body jointly form an insertion space, and once the connector and the another connector are connected, the insertion space is inserted by a corresponding portion of the another connector.

8. The connector of claim 3, wherein the two guiding portions of the shell are adjacent to two opposite ends of the insertion hole respectively, an end edge of one of the guiding portions of the shell corresponds and connects to an end edge of another one of the guiding portions of the shell to form a space forming portion between the guiding portions of the shell, an inner side of the space forming portion and an outer side of a sidewall of the insulating body jointly form an insertion space, and once the connector and the another connector are connected, the insertion space is inserted by a corresponding portion of the another connector.

9. The connector of claim 4, wherein the two guiding portions of the shell are adjacent to two opposite ends of the insertion hole respectively, an end edge of one of the guiding portions of the shell corresponds and connects to an end edge of another one of the guiding portions of the shell to form a space forming portion between the guiding portions of the shell, an inner side of the space forming portion and an outer side of a sidewall of the insulating body jointly form an insertion space, and once the connector and the another connector are connected, the insertion space is inserted by a corresponding portion of the another connector.

10. A shell, configured to be applied to a connector and having a rectangular-shaped cross section, wherein a vertically throughgoing assembly space is formed in the shell, and an insulating body is able to extend into and be fixed in the assembly space, the shell being characterized in that:

the shell has two guiding portions on a same side and has a rear side formed with at least two engaging holes corresponding respectively in position to the two guiding portions and extending upward from a bottom edge of the shell the two guiding portions extend upward from a portion of a top edge of the shell, the guiding portions are plate-shaped, and to connect another connector to the connector, the another connector is able to be pressed against the guiding portions in order to be guided by the guiding portions into electrical connection with the connector;

wherein when the insulating body extends into the assembly space, a protruding block on a rear side of the insulating body extends into, and presses against a wall of, a corresponding one of the engaging holes.

11. The shell of claim 10, wherein the shell has a left sidewall and a right sidewall each provided with an engaging plate, each said engaging plate protrudes toward the assembly space, and when the insulating body extends into the assembly space, each said engaging plate extends into, and presses against a wall of, a groove in a corresponding sidewall of the insulating body.

12. The shell of claim 10, wherein the two guiding portions are spaced apart, an end edge of one of the guiding portions corresponds and connects to an end edge of another one of the guiding portions to form a space forming portion between the guiding portions, an inner side of the space forming portion and an outer side of a sidewall of the insulating body jointly form an insertion space, and once the connector and the another connector are connected, the insertion space is inserted by a corresponding portion of the another connector.

13. The shell of claim 11, wherein the two guiding portions are spaced apart, an end edge of one of the guiding portions corresponds and connects to an end edge of another one of the guiding portions to form a space forming portion between the guiding portions, an inner side of the space forming portion and an outer side of a sidewall of the insulating body jointly form an insertion space, and once the connector and the another connector are connected, the insertion space is inserted by a corresponding portion of the another connector.

14. The shell of claim 10, wherein the two guiding portions are spaced apart, an end edge of one of the guiding portions corresponds and connects to an end edge of another one of the guiding portions to form a space forming portion between the guiding portions, an inner side of the space forming portion and an outer side of a sidewall of the insulating body jointly form an insertion space, and once the connector and the another connector are connected, the insertion space is inserted by a corresponding portion of the another connector.

* * * * *